US005630632A

United States Patent [19]

Swan

[11] Patent Number: 5,630,632

[45] Date of Patent: May 20, 1997

[54] QUARTER TURN LATCH

[75] Inventor: David A. Swan, Shoreview, Minn.

[73] Assignee: Federal-Hoffman, Inc., Anoka, Minn.

[21] Appl. No.: 350,654

[22] Filed: Dec. 7, 1994

[51] Int. Cl.[6] ..... E05C 3/02

[52] U.S. Cl. ..... 292/240; 292/DIG. 53; 292/202

[58] Field of Search ..... 292/240, 197, 292/210, 304, 198, DIG. 53, 202

[56] References Cited

U.S. PATENT DOCUMENTS

| | | | |
|---|---|---|---|
| 2,018,098 | 10/1935 | Sullivan | 292/202 |
| 3,951,444 | 4/1976 | Shull | 292/201 X |
| 4,186,952 | 2/1980 | Glass | 292/DIG. 53 X |
| 4,325,239 | 4/1982 | Larson | 292/202 X |
| 4,331,413 | 5/1982 | Hoen | 411/44 |
| 4,657,462 | 4/1987 | Hoen | 411/552 |
| 4,910,982 | 3/1990 | Dana | 70/370 |
| 4,951,980 | 8/1990 | Wetzel | 292/DIG. 53 X |
| 4,995,652 | 2/1991 | Mugnalo | 292/DIG. 33 X |
| 5,413,392 | 5/1995 | Schlack et al. | 292/204 |

FOREIGN PATENT DOCUMENTS

| | | | |
|---|---|---|---|
| 9202703 | 2/1992 | United Kingdom | 292/169 |

OTHER PUBLICATIONS

Southco, Inc. 1993 Catalog.
Dirak GmbH Normont Catalog (Distributor) 1993 Catalog.
Eberhard Mfg. Co. 1994 Catalog.
EMKA Beschlagteile 1994 Catalog.

*Primary Examiner*—Rodney M. Lindsey
*Assistant Examiner*—Monica E. Millner
*Attorney, Agent, or Firm*—Merchant, Gould, Smith, Edell, Welter & Schmidt

[57] ABSTRACT

A quarter turn latch (10) includes a latching member (12) connecting to an actuating member (14). The latching member (12) and actuating member (14) snap together from opposite sides of a mounting surface member (100). The latching member (12) includes a cam member (20) for engaging the complimentary latch member (102) to retain it against the mounting surface member (100). The mounting surface has a depressed portion (16) with an orifice (18) formed therein. The orifice has opposed straight sides (70) and rounded end portions (72). The actuating member includes a barrel shaped body (24) having opposed rounded larger radius corner portions (32) and opposed squared corner portions (34). The actuating member provides for rotation along the rounded portions (32) against the end portion (72) and straight side (70) while the squared portions (34) engage the straight side portion (70) to limit rotation to one quarter turn.

15 Claims, 2 Drawing Sheets

QUARTER TURN LATCH

BACKGROUND OF THE INVENTION

1. Field of the Invention

The present invention is directed to a quarter turn latch, and in particular, to a two piece quarter turn latch having snap together construction.

2. Description of the Prior Art

Quarter turn latches are widely known and are used for latching a variety of cabinets, doors, and other enclosures. Quarter turn latches are typically actuatable between a first position wherein the enclosure is latched, and a second position, wherein the latch is rotated 90° from the first position and the enclosure is unlatched.

Quarter turn latches used for enclosures typically have a construction which extends on both sides of the enclosure door or frame. The latches typically have a bolt or other connector extending through the assembly and often have washers, gaskets, O-rings or other seals, depending on the intended use of the enclosure. The relatively high number of elements required for the latch increases cost, complexity and assembly time. In addition, the frame and/or door may require extensive modifications to accommodate latches.

It can be seen then that a quarter turn latch is needed which is easily actuated and which requires a minimum number of parts. Furthermore, a quarter turn latch should be easily assembled and preferably use a snap lock assembly. The latch should provide a dust tight barrier without use of additional gaskets or seals. The enclosure receiving the latch should require very little modification to receive the latch. The present invention addresses these as well as other problems associated with quarter turn latches.

SUMMARY OF THE INVENTION

The present invention is directed to a quarter turn latch, and in particular to a quarter turn latch having two pieces which snap together for simple assembly. According to the present invention, the latch has an actuating member which connects to a latching member. The actuating member and latching member connect through an orifice formed in the mounting surface, which may be either on the enclosure frame or door. The latching member includes a retainer portion which engages the frame if the latch is mounted on the door and engages the door if the latch is mounted on the frame.

The actuating member includes a substantially barrel shaped body with somewhat rhombus shaped profile having diametrically opposed rounded corners alternating with square corners at the other diametrically opposed portions. In addition, at the bottom of the actuating member, tabs are formed which have a slight barb for engaging complementing members on the latching member to mount and retain the two members together. In addition, the actuating member includes a slot or other structure for receiving a handle or other actuating tool formed in the top portion thereof.

The latching member includes a retaining portion which may be cammed to engage the frame or door complementary to the surface on which it is mounted. The latching member has a body with a dish shaped portion leading to a rectangular bottom portion. The bottom portion has opposed tabs which receive the actuating member and engage the tabs of the actuating member to lock the two members together. The latching member also includes radially extending outer spring type tabs which are spaced equally apart and engage the mounting surface to position the latching member and act as a bearing surface against the mounting surface for improved rotation.

The mounting surface of the enclosure has a depressed portion which substantially follows the dish portion of the latching member. An elongated orifice is formed therein which has opposed straight sides and rounded end portions. The straight sides engage the square portions of the actuating member to prevent more than 90° rotation. The rounded end portions provide for rotation of the latch in the orifice between the latched and unlatched positions.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENT

Figure 1:
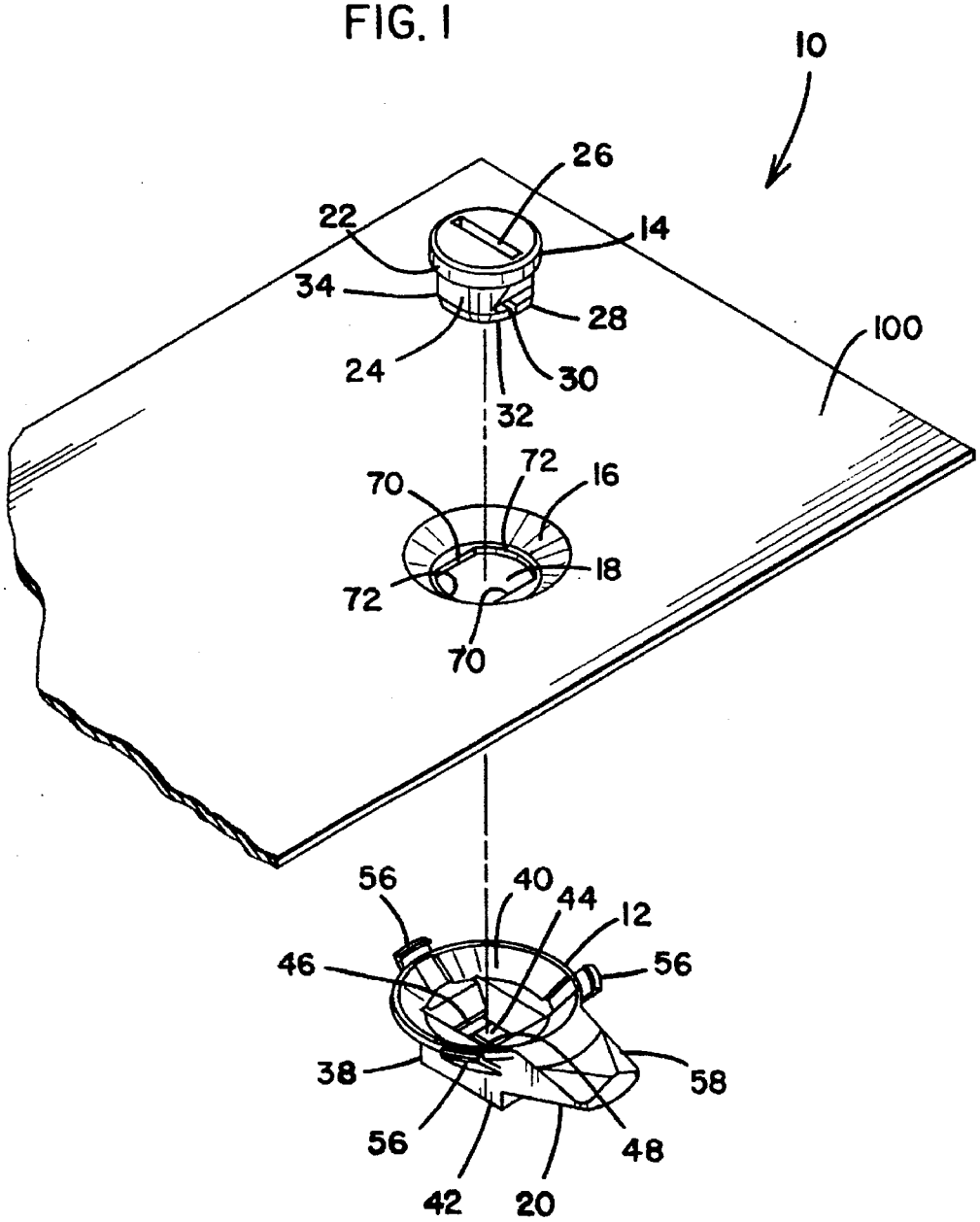
FIG. 1 shows an exploded view of a quarter turn latch and mounting surface member according to the principles of the present invention.

Referring now to the drawings, and in particular to FIG. 1, there is shown a quarter turn latch, generally designated 10. Latch 10 includes a latching member 12 and an actuating member 14. It can be appreciated that the latch 10 may be constructed of many materials. However, in a preferred embodiment, the latching member 12 is a nylon or plastic and the actuating member 14 is a similar material or a metal. The materials will depend on the size and uses for the latch 10. The members 12 and 14 are connected by inserting the actuating member 14 through an orifice 18 in a mounting surface 100 to connect to the latching member 12.

The mounting surface 100, which may be either the door or frame and is typically sheet metal, has an orifice 18 formed therein. In the preferred embodiment, the orifice 18 is surrounded by a depressed portion 16 forming a ridge around the orifice 18. In the preferred embodiment, the orifice 18 is a double-D type orifice having opposed straight sides 70 with rounded end portions 72. In this manner, rotation of the latch 10 is limited by portions of the actuating member 14 engaging the side portions 70, which are spaced closer than the end portions 72, as explained hereinafter.

The actuating member 14 includes a hollow substantially barrel type body 24 with a substantially rhombus shaped outer contour and an upper cap portion 22 having a larger diameter than the body 24 of the actuating member 14. The cap portion 22 includes a slot 26 formed therein for receiving a screwdriver or other tool for rotating the latch. Although in the preferred embodiment a slot 26 is shown, it can be appreciated that other types of actuators including, but not limited to, hex heads, Phillips, or hand actuated handles or knobs may be used. In addition, at the lower portion of the barrel portion 24, retaining tabs 28 are formed which extend outward and engage the latching member 12, as explained hereinafter, to attach the actuating member 14 to the latching member 12. In addition, the actuating member 14 also has rounded corners 32 at diametrically opposed portions of the body 24 and more squared corners 34 at the other diametrically opposed portions of the body 24, as shown more clearly in FIGS. 3 and 4. This provides for rotation within a limited 90° range of motion in the orifice 18, as explained hereinafter. The rounded portions 32 have a much larger radius and are closer together than the squared or pointed corner portions 34.

Figure 2:
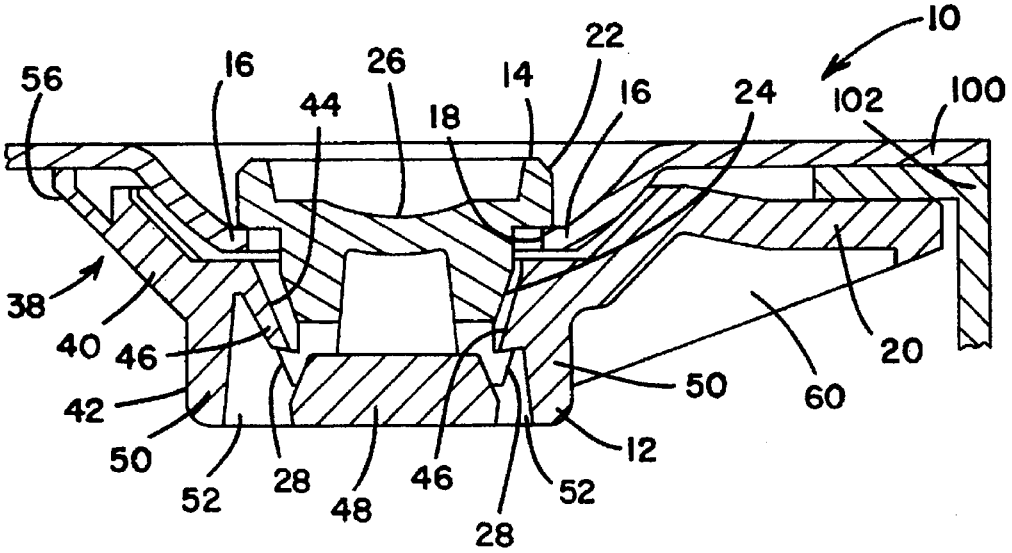
FIG. 2 shows a side sectional view of the quarter turn latch shown in FIG. 1.

Referring now to FIGS. 1 and 2, the latching member 12 includes a latch member body 38 having a retainer portion 20 extending therefrom for latching a complementary latched member 102 to the mounting surface member 100. It can be appreciated that the members 100 and 102 are either the door or frame, depending on the needs and/or uses of the enclosure. The retainer portion 20 is rotated to engage the frame or door complementary to the mounting surface member 100 on which it is mounted. In the preferred embodiment, retainer portion 20 includes a cammed surface 58 for facilitating easier latching and providing mechanical advantage when latching and unlatching. As shown in FIG. 2, in the preferred embodiment, the cam member 20 includes a hollowed out portion 60 for reducing the amount of material and cost of manufacture for the latch member 12.

The latch member body 38 includes a bottom substantially rectangular portion 42 having a rounded dish portion 40 extending upward and outward therefrom. The bottom portion 42 forms a receiving chamber 44 for receiving the actuating member 14, as also shown in FIG. 2. The bottom portion 42 includes barbed flanges 46 at opposite ends, for engaging the actuating member 14, as explained hereinafter. In addition, a center tab 48 extends upward for aligning with the slot 30 of the actuating member 14. The bottom portion 42 forms a nonconducting barrier between the actuating member 14 and the interior of the enclosure and acts to isolate the actuating member 14 from the interior of the enclosure. It can be appreciated that should there be stray wires or electric currents in the enclosure, the actuating member 14 is isolated from the interior by the bottom portion 42. Therefor, the actuating member 14 cannot be a conductor, preventing accidental shock or electrocution. Outer flange members 56 extend radially outward from the dish portion and engage the mounting surface 100 when assembled. In the preferred embodiment, three flange members 56 are spaced at equal distances about the dish portion 40 for positioning and aligning the latch 10 and to compensate for varying thickness of the sheet metal or other material of the mounting surface 100.

Referring to FIG. 2, when assembled, the latch 10 has the latching member 12 on one side of the mounting surface member 100 with the actuating member 14 extending through the orifice 18 of the mounting surface to engage the latching member 12. The body 24 of the actuating member 14 extends through the orifice 18 to assemble the latch 10. The latching member 12 then is placed against the actuating member 14 so that the barbed flanges 28 of the actuating member 14 slip past and engage the complementary flanges 46 of the latching member 12. In this position, efforts to pull the members 12 and 14 apart tightens the barbs of the flanges 28 and 46 against one another to prevent separation. However, the flanges 46 can be pried apart for removing the latch 10 and for interchanging the actuating member 14 and/or the latching member 12. It can be appreciated that when assembled, the upper cap portion 22 rests against the underside of the depressed portion 16 of the mounting surface 100 to prevent dust from leaking through the latch 10. The outer flanges 56 of the latching member 12 engage the mounting surface 100 on its opposite side. In addition, the dish portion 40 proximate the latching portion 20 also engages the depressed portion 16 of the mounting surface 100. The actuating member 14 is aligned with the latching member 12 by the center tab 48 extending up through the slot 30 formed in the actuating member 14. This prevents rotation of the actuating member 14 relative to the latching member 12.

In the latched position, as shown in FIG. 2, the latching portion 20 retains the latched member 102 against the mounting surface member 100. Rotation of the latch 10 moves the retainer portion 20 90° so that it disengages the complementary latched member 102. The latched member 102 may then be separated from the mounting surface member 100.

Figure 3:
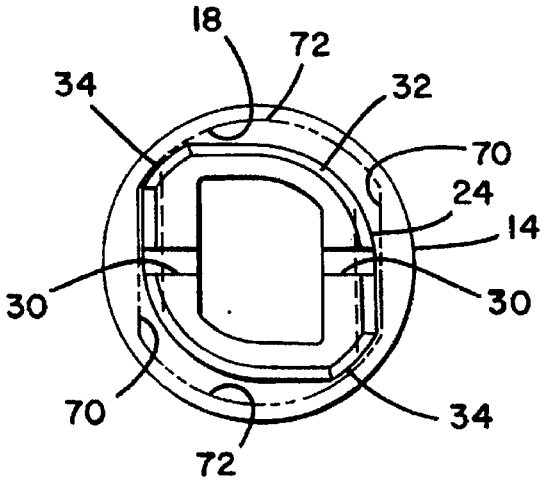
FIG. 3 shows a bottom plan view of the actuating member and the orifice for the quarter turn latch shown in FIG. 1; and, FIG. 4 shows a bottom plan view of the actuating member shown in FIG. 3 and rotated ninety degrees.
Figure 4:
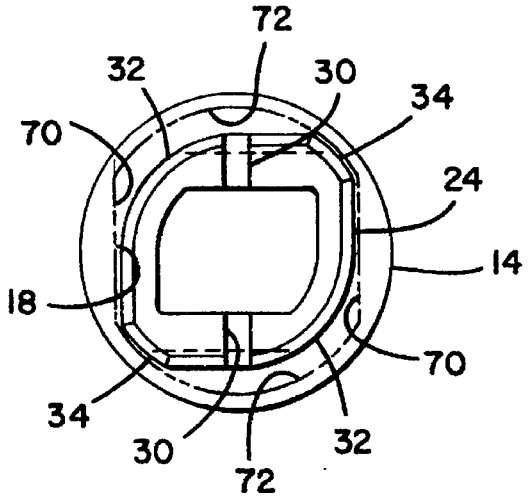

Referring now to FIGS. 3 and 4, in FIG. 3 the latch 10 is shown in a first position wherein rotation can only occur in a clockwise direction as viewed from below. The straight side portions 70 of the orifice 18 engage the more squared corners 34 of the actuating member 14. This prevents any rotation in a counter-clockwise direction. However, the corners 34 may slide freely along the rounded end portions 72 of the orifice 18. The more rounded portions 32 of the actuating member 14 have a much larger radius curve, but are closer together and can slide freely along the straight side portions 70. However, when the actuating member 14 is rotated clockwise from the position shown in FIG. 3, after 90° of rotation it achieves the position shown in FIG. 4. In this position, the corner portions 34 of the actuating member 14 engage straight side portions 70 of the orifice 18, preventing further clockwise rotation from the position shown in FIG. 4. However, rotation from the position shown in FIG. 4 is possible only in a counter-clockwise direction. The corner portions 34 can slide freely along the rounded portions 72 of the orifice 18. The larger radius rounded portions 32 of the actuating member 14 may slide freely along the straight side portions 70 of the orifice 18. However, rotation is limited to 90° in a counter-clockwise direction from the position shown in FIG. 4. After 90° rotation in the counter-clockwise direction, the alignment shown in FIG. 3 is again achieved. It can be appreciated that in this manner, rotation of the latch 10 is limited to a 90°, or a one quarter turn rotation.

The latching position may be either of the positions shown in FIGS. 3 or 4, depending upon the orientation of the orifice 18 relative to the edge of the mounting surface member 100 and the latched member 102.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A quarter turn latch attached to a mounting surface, comprising:

a latching member including an integrally formed engaging portion on a first side of the mounting surface;

an actuating member on a second side of the mounting surface including rotation limiting means for limiting rotation of the latch, wherein the latching member includes means for attaching to the actuating member so that the actuating member and latching member rotate together;

wherein the mounting surface comprises a substantially planar mounting surface having a raised portion extending out of the plane of the mounting surface and having an orifice formed therein receiving the latch.

2. A quarter turn latch attached to a mounting surface, comprising:

a latching member including an integrally formed engaging portion on a first side of the mounting surface;

an actuating member on a second side of the mounting surface including rotation limiting means for limiting rotation of the latch, wherein the latching member includes means for attaching to the actuating member so that the actuating member and latching member rotate together;

wherein the actuating member includes depressions formed in opposed sides of the actuating member, wherein the depressions define barbed tabs engaging opposing barbed flanges for retaining the actuating member and latching member together.

3. A quarter turn latch according to claim 1, further comprising alignment means for aligning the actuating member relative to the latching member.

4. A quarter turn latch according to claim 3, wherein the alignment means comprises a center piece integrally formed with and extending from the latching member toward the actuating member and wherein the actuating member defines a channel formed therein for receiving the center piece.

5. A quarter turn latch attached to a mounting surface, comprising:

a raised portion extending out of the plane of the mounting surface and having an orifice formed therein;

a latching member including an engaging portion on a first side of the mounting surface;

an actuating member on a second side of the mounting surface inserting through the orifice, including rotation limiting means for limiting rotation of the latch, wherein the rotation limiting means comprises an actuating member body having first opposed corners alternating with second opposed rounded corners and wherein the orifice is elongated with a first dimension greater than a second dimension; and means for attaching the latching member to the actuating member.

6. A quarter turn latch according to claim 5, wherein the distance between the second opposed rounded corners of the actuating member body is less than the second dimension of the orifice.

7. A quarter turn latch according to claim 6, wherein the distance between the first opposed corners of the actuating member body is greater than the second dimension of the orifice.

8. A quarter turn latch attached to a mounting surface, comprising:

a raised portion extending out of the plane of the mounting surface and having and defining an orifice therein;

an actuating member on a first side of the mounting surface inserting through the orifice, having a barrel type body defining opposed flanges at a lower portion of the body; and a latching member on a second side of the mounting surface, the latching member having a dish portion and bottom portion extending downward from the dish portion, the bottom portion defining a receiving chamber configured for receiving the actuating member, and having complementary flanges for engaging the flanges of the latching member to attach to the actuating member, and wherein the latching member has a latching portion extending radially from the dish portion.

9. A latch according to claim 8, further comprising alignment means for aligning the actuating member relative to the latching member.

10. A latch according to claim 9, wherein the alignment means comprise a slot formed in the body of the actuating member body and a tab extending upward from the bottom portion of the latching member.

11. A latch according to claim 8, further comprising spring type tab members spaced around a periphery of the dish portion and extending radially outward from the dish portion and engaging the mounting surface.

12. An enclosure, having a quarter-turn latch attached to a mounting surface of the enclosure, comprising:

a latching member including an integrally formed engaging portion on a first side of the mounting surface:

an actuating member on a second side of the mounting surface including a portion having first diametrically opposed corners and second diametrically opposed rounded corners, wherein the mounting surface includes an elongated opening formed therein having a first dimension greater than a second dimension;

wherein a distance between the first diametrically opposed corners is greater than a distance between the second diametrically opposed corners and greater than the second dimension, and wherein the diametrically opposed first corners engage opposed sides of the second dimension in a first position, and wherein the diametrically opposed first corners engage opposite the opposed sides of the second dimension in a second position to limit rotation, wherein the latching member includes means for attaching to the actuating member.

13. An enclosure according to claim 12, wherein the latching member mounts to the actuating member and forms a barrier between an interior of the enclosure and the actuating member.

14. A quarter turn latch comprising:

a latch member including an integrally formed lower portion having a base and side portions, the base having a tab extending upward therefrom and opposed flanges extending downward from an upper edge of the sides, an annular portion connecting to an upper edge of the lower portion and extending radially outward from the lower portion, and a cam portion extending from a side of the lower and annular portions;

an actuating member having a planar upper surface, a barrel portion extending downward from the upper surface, the barrel portion including barbs proximate a lower edge of the barrel portion and extending from opposed sides of the barrel portion, the barrel portion including a channel formed in a lower surface, the sides of the barrel defining diametrically opposed first corners and diametrically opposed second rounded corners;

wherein when assembled, the barbs engage the flanges and the tab inserts into the channel.

15. An enclosure according to claim 12, wherein the orifice comprises a double-D shaped orifice.

* * * * *